US008570250B2

(12) United States Patent
Kang et al.

(10) Patent No.: US 8,570,250 B2
(45) Date of Patent: Oct. 29, 2013

(54) ORGANIC LIGHT EMITTING DISPLAY AND METHOD OF DRIVING THE SAME

(75) Inventors: Chul-Kyu Kang, Yongin (KR); Yong-Sung Park, Yongin (KR); Young-In Hwang, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 237 days.

(21) Appl. No.: 12/975,843

(22) Filed: Dec. 22, 2010

(65) Prior Publication Data

US 2012/0038606 A1 Feb. 16, 2012

(30) Foreign Application Priority Data

Aug. 10, 2010 (KR) ..... 10-2010-0076852

(51) Int. Cl.
*G09G 3/30* (2006.01)

(52) U.S. Cl.
USPC ..... 345/76; 345/82; 315/169.3

(58) Field of Classification Search
USPC ..... 345/76–83, 204, 211; 315/169.3
See application file for complete search history.

(56) References Cited

U.S. PATENT DOCUMENTS

2004/0001054 A1* 1/2004 Nitta et al. ..... 345/204
2005/0110726 A1* 5/2005 Shin ..... 345/76
2007/0030219 A1* 2/2007 Park et al. ..... 345/76
2008/0252569 A1* 10/2008 Kwon ..... 345/76
2009/0225011 A1* 9/2009 Choi ..... 345/77
2009/0243979 A1* 10/2009 Kim ..... 345/76
2010/0141564 A1 6/2010 Choi et al.

FOREIGN PATENT DOCUMENTS

KR 10-0907391 7/2009
KR 10-2010-0064620 6/2010

* cited by examiner

*Primary Examiner* — Amare Mengistu
*Assistant Examiner* — Koosha Sharifi-Tafreshi
(74) *Attorney, Agent, or Firm* — Christie, Parker & Hale, LLP

(57) ABSTRACT

An organic light emitting display includes a pixel unit having pixels coupled to scan lines, first control lines, second control lines, data lines, and first and second power sources, a control line driver for providing a first control signal and a second control signal to the pixels through the first control lines and the second control lines, a scan driver for providing scan signals to the pixels through the scan lines, and a data driver for providing data signals to the pixels through data lines. The scan driver simultaneously supplies a first scan signal to the pixels through the scan signals. In the organic light emitting display, deviation in the threshold voltages of the driving transistors included in the pixels is compensated without a power swing so as to display an image with uniform brightness.

8 Claims, 3 Drawing Sheets

ORGANIC LIGHT EMITTING DISPLAY AND METHOD OF DRIVING THE SAME

CROSS-REFERENCE TO RELATED APPLICATION

This application claims priority to and the benefit of Korean Patent Application No. 10-2010-0076852, filed on Aug. 10, 2010, in the Korean Intellectual Property Office, the entire disclosure of which is incorporated herein by reference.

BACKGROUND

1. Field

An aspect of the present invention relates to an organic light emitting display and a method of driving the same. More particularly, an aspect of the present invention relates to an organic light emitting display capable of compensating for deviation in a threshold voltage without a voltage swing and a method of driving the same.

2. Description of the Related Art

Recently, various flat panel displays (FPD) having reduced weight and volume as compared to cathode ray tubes (CRT) have been developed. The FPDs include liquid crystal displays (LCD), field emission displays (FED), plasma display panels (PDP), and organic light emitting displays.

Among the FPDs, the organic light emitting displays display images using organic light emitting diodes (OLED) which generate light by the re-combination of electrons and holes. The organic light emitting display has high response speed and is driven with low power consumption.

In general, the OLED is divided into a passive matrix type OLED (PMOLED) and an active matrix type OLED (AMOLED) according to a method of driving the OLED. The AMOLED includes a plurality of gate lines, a plurality of data lines, a plurality of power source lines, and a plurality of pixels coupled to the above lines to be arranged in the form of a matrix. In addition, each of the pixels commonly includes an OLED, two transistors, that is, a switching transistor for transmitting a data signal and a driving transistor for driving the organic light emitting diode (OLED) in accordance with the data signal, and a capacitor for maintaining the data voltage.

However, the conventional organic light emitting display may not display an image with uniform brightness due to a deviation in a threshold voltage. In detail, the threshold voltages of the driving transistors included in the pixels are different from each other due to a deviation in manufacturing. Therefore, although the data signal corresponding to the same gray scale is supplied to the plurality of pixels, due to a difference in the threshold voltage of each of the driving transistors of the pixels, brightness becomes non-uniform.

SUMMARY

Accordingly, an aspect of the present invention provides an organic light emitting display capable of compensating for deviation in the threshold voltages of the driving transistors included in the pixels without a power swing in order to display an image with uniform brightness and a method of driving the same.

According to another aspect of the present invention, there is provided an organic light emitting display, including a pixel unit including pixels coupled to scan lines, first control lines, second control lines, data lines, and first and second power sources, a control line driver for providing a first control signal and a second control signal to the pixels through the first control lines and the second control lines, a scan driver for providing scan signals to the pixels through the scan lines, and a data driver for providing data signals to the pixels through data lines. The scan driver simultaneously supplies a first scan signal to the pixels through the scan signals.

According to another aspect of the present invention, the data driver simultaneously supplies an initializing signal to the pixels through the data lines in a period where the first scan signal is supplied.

According to another aspect of the present invention, the scan driver sequentially supplies a second scan signal to the scan lines when supplying of the first scan signal is completed.

According to another aspect of the present invention, each of the pixels includes an organic light emitting diode (OLED) having a cathode electrode coupled to a second power source, a first transistor having a first electrode coupled to a first power source, a second transistor having a first electrode coupled to a gate electrode of the first transistor, having a second electrode coupled to a data line, and having a gate electrode coupled to a scan line, a third transistor having a first electrode coupled to a second electrode of the first transistor, having a second electrode coupled to a first node, and having a gate electrode coupled to a first control line, a fourth transistor having a first electrode coupled to the first node, having a second electrode coupled to an anode electrode of the OLED, and having a gate electrode coupled to a second control line, a first capacitor coupled between the gate electrode of the first transistor and the first node, and a second capacitor coupled between the first node and the anode electrode of the OLED.

According to another aspect of the present invention, each of the first to fourth transistors is one of a PMOS transistor and an NMOS transistor.

According to another aspect of the present invention, there is provided a method of driving an organic light emitting display device, including simultaneously supplying a first scan signal and a second control signal to pixels that constitute a pixel unit so that a voltage corresponding to a difference between an initializing signal and an anode electrode voltage of an OLED is charged in a first capacitor, simultaneously supplying the first scan signal and a first control signal to the pixels so that a first node voltage of each of the pixels is increased to a voltage corresponding to a difference between an initializing signal and a threshold voltage of a first transistor, sequentially supplying a second scan signal to the pixels and applying data signals to the pixels to which the second scan signal is supplied so that a voltage corresponding to a data signal is charged in first capacitors of the pixels, and simultaneously supplying a first control signal and a second control signal to the pixels so that the pixels simultaneously emit light with brightness components corresponding to the voltages charged in the first capacitors of the pixels.

According to another aspect of the present invention, the first control signal and the second control signal do not simultaneously supply a first scan signal and a second control signal to pixels that constitute a pixel unit so that a voltage corresponding to a difference between an initializing signal and an anode electrode voltage of an OLED is charged in a first capacitor and simultaneously supplying the first scan signal and a first control signal to the pixels so that a first node voltage of each of the pixels is increased to a voltage corresponding to a difference between an initializing signal and a threshold voltage of a first transistor.

According to another aspect of the present invention, the first and second scan signals are simultaneously and continuously supplied to pixels that constitute a pixel unit so that a voltage corresponding to a difference between an initializing signal and an anode electrode voltage of an OLED is charged in a first capacitor and a first node voltage of each of the pixels is increased to a voltage corresponding to a difference between an initializing signal and a threshold voltage of a first transistor.

According to an aspect of the present invention there is provided an organic light emitting display in which deviation of the threshold voltages of the driving transistors included in the pixels is compensated without a power swing so that the organic light emitting display displays an image with uniform brightness and a method of driving the same.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Figure 1:
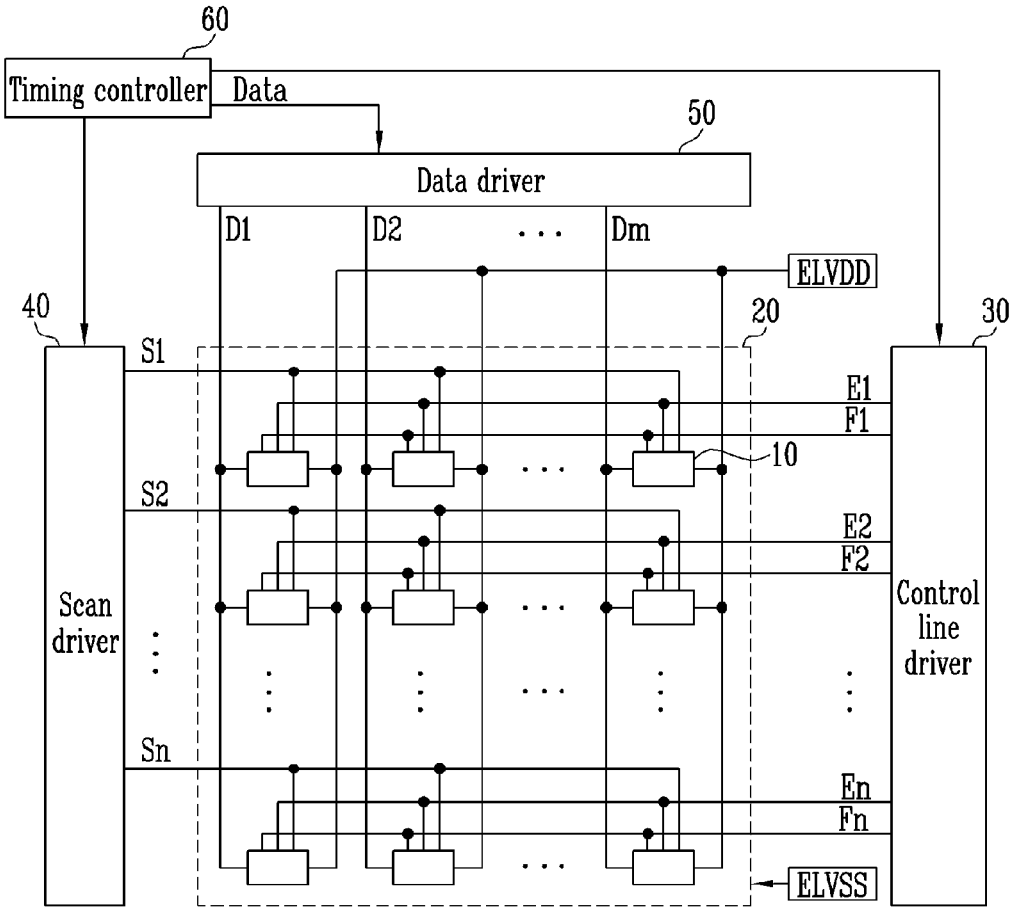
FIG. 1 is a view illustrating an organic light emitting display according to an exemplary embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

The advantages and characteristics of the aspects of the present invention and a method of achieving the advantages and characteristics of the present invention now will be described more fully with reference to the accompanying drawings, in which exemplary embodiments of the invention are shown. This invention may, however, be embodied in many different forms and should not be construed as being limited to the embodiments set forth herein.

Hereinafter, aspects of the present invention will be described with reference to drawings for describing an organic light emitting display and a method of driving the same according to the embodiments of the present invention.

FIG. 1 is a view illustrating an organic light emitting display according to an exemplary embodiment of the present invention. Referring to FIG. 1, the organic light emitting display includes a pixel unit 20 including pixels 10 coupled to scan lines S1 to Sn, first control lines E1 to En, second control lines F1 to Fn, data lines D1 to Dm, a first power source ELVDD, a second power source ELVSS, a control line driver 30 for supplying a first control signal and a second control signal to the pixels 10 through the first control lines E1 to En and the second control lines F1 to Fn, a scan driver 40 for supplying scan signals to the pixels 10 through the scan lines S1 to Sn, and a data driver 50 for supplying data signals to the pixels 10 through data lines D1 to Dm. While not required in all aspects, the shown organic light emitting display further includes a timing controller 60 for controlling the control line driver, the scan driver 40, and the data driver 50.

The pixels 10 are coupled to the first power source ELVDD and the second power source ELVSS. The pixels 10 that received a voltage from the first power source ELVDD and the second power source ELVSS generate light corresponding to the data signals according to the current that flows from the first power source ELVDD to the second power source ELVSS via an organic light emitting diode (OLED).

The timing controller 60 controls the control line driver 30 so as to generate the first control signal and the second control signal, and the control line driver 30 supplies the generated first control signal to the first control lines E1 to En, and supplies the generated second control signal to the second control lines F1 to Fn. In FIG. 1, the control line driver 30 is illustrated as being separate from the scan driver 40. However, the control line driver 30 may be included in the scan driver 40 in other aspects.

The timing controller 60 controls the scan driver 40 so as to generate the scan signals and the scan driver 40 simultaneously and sequentially supplies the generated scan signals to the scan lines S1 to Sn. In particular, the scan driver 40 supplies scan signals twice in one frame to the scan lines S1 to Sn.

Of the scan signals supplied twice in one frame, the scan signal supplied first is defined as a first scan signal and the scan signal supplied second is defined as a second scan signal. The supply period of the first scan signal may be longer than the supply period of the second scan signal.

In addition, the first scan signal is simultaneously supplied to the scan lines S1 to Sn, however, the second scan signal is sequentially supplied from the first scan line S1 to the nth scan line Sn.

The timing controller 60 controls the data driver 50 so as to generate the data signals and the data driver 50 supplies the generated data signals to the data lines D1 to Dm. In addition, the data driver 50 simultaneously supplies an initializing signal V0 to the data lines D1 to Dm in a period where the first scan signal is supplied in order to initialize the voltage of the pixels 10 and to compensate for the threshold voltage Vth.

Figure 2:
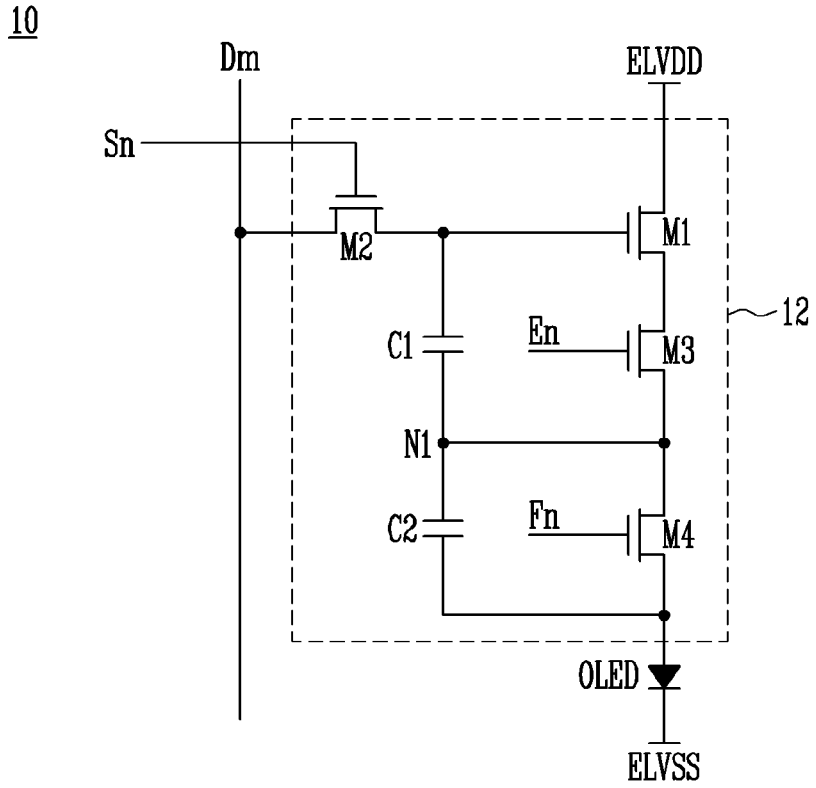
FIG. 2 is a view illustrating a pixel according to an exemplary embodiment of the present invention.

FIG. 2 is a view illustrating the pixel 10 according to an exemplary embodiment of the present invention. In FIG. 2, for convenience of explanation, the pixel 10 coupled to the nth scan line Sn and the mth data line Dm will be illustrated.

Referring to FIG. 2, the pixel 10 includes a pixel circuit 12 coupled to the OLED, the data line Dm, and the scan line Sn to control the amount of current supplied to the OLED. The anode electrode of the OLED is coupled to the pixel circuit 12 and the cathode electrode of the OLED is coupled to the second power source ELVSS. The OLED generates light with a predetermined brightness corresponding to the current supplied from the pixel circuit 12.

The pixel circuit 12 controls the current that flows from the first power source ELVDD to the second power source ELVSS via the OLED to correspond to the data signal supplied to the data line Dm when a scans signal is supplied to the scan line Sn. Therefore, the pixel circuit 12 includes first to fourth transistors M1 to M4, a first capacitor C1, and a second capacitor C2.

The first transistor M1 is a driving transistor that generates the current corresponding to a voltage between a gate electrode and a second electrode of the first transistor M1 to supply the current to the OLED. Therefore, the first electrode of the first transistor M1 is coupled to the first power source ELVDD, the second electrode of the first transistor M1 is coupled to the first electrode of the third transistor M3, and the gate electrode of the first transistor M1 is coupled to the first electrode of the second transistor M2.

The first electrode of the second transistor M2 is coupled to the gate electrode of the first transistor M1, the second electrode of the second transistor M2 is coupled to the data line Dm, and the gate electrode of the second transistor M2 is coupled to the scan line Sn. The second transistor M2 is turned on when the first scan signal or the second scan signal is supplied from the scan line Sn to transmit the initializing signal V0 or the data signal supplied from the data line Dm to the gate electrode of the first transistor M1. The second transistor M2 is turned off when the scan signal is not supplied to block the initializing signal V0 and the data signal.

The first electrode of the third transistor M3 is coupled to the second electrode of the first transistor M1, the second electrode of the third transistor M3 is coupled to a first node N1, and the gate electrode of the third transistor M3 is coupled to the first control line En. In addition, the third transistor M3 is turned on when a first control signal is supplied to the gate electrode of the third transistor M3 from the first control line En to electrically couple the second electrode of the first transistor M1 and the first node N1. The third transistor M3 is turned off when the first control signal is not supplied to the gate electrode of the third transistor M3 in order to block the second electrode of the first transistor M1 from the first node N1.

The first electrode of the fourth transistor M4 is coupled to the first node N1. The second electrode of the fourth transistor M4 is coupled to the anode electrode of the OLED. The gate electrode of the fourth transistor M4 is coupled to the second control line Fn. In addition, the fourth transistor M4 is turned on when a second control signal is supplied from the second control line Fn to the gate electrode of the fourth transistor M4 to electrically couple the anode electrode of the OLED to the first node N1. The fourth transistor M4 is turned off when the second control signal is not supplied to the gate electrode of the fourth transistor M4 to block the anode electrode of the OLED from the first node N1.

One terminal of the first capacitor C1 is coupled to the gate electrode of the first transistor M1 and the other terminal of the first capacitor C1 is coupled to the first node N1. One terminal of the second capacitor C2 is coupled to the first node N1 and the other terminal of the second capacitor C2 is coupled to the anode electrode of the OLED.

The second electrode of the third transistor M3, the first electrode of the fourth transistor M4, the other terminal of the first capacitor C1, and one terminal of the second capacitor C2 are coupled to the first node N1.

The anode electrode of the OLED is coupled to the second electrode of the fourth transistor M4 and the cathode electrode of the OLED is coupled to the second power source ELVSS to generate the light corresponding to the driving current generated by the first transistor M1.

The first power source ELVDD, which is a high potential power source, is coupled to the first electrode of the first transistor M1.

The second power source ELVSS, which is a low potential power source having a lower voltage level than the first power source ELVDD, is coupled to the cathode electrode of the OLED.

Figure 4:
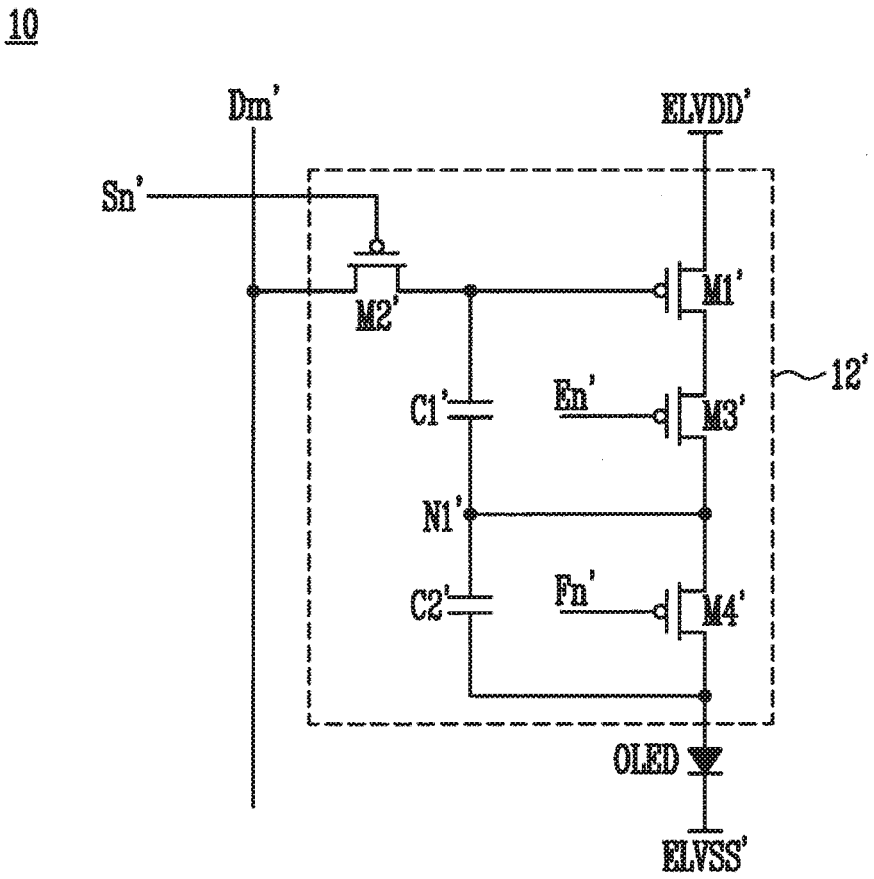
FIG. 4 is a view illustrating a pixel according to an exemplary embodiment of the present invention.

The above-described first to fourth transistors M1 to M4 may be formed as NMOS transistors as illustrated in FIG. 2 and may be formed by PMOS transistors as illustrated in FIG. 4.

Figure 3:
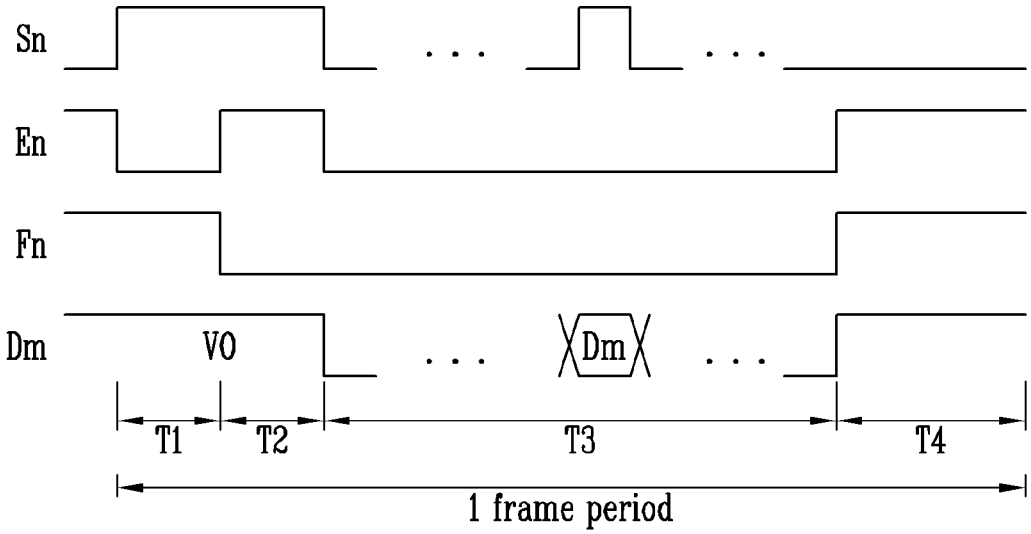
FIG. 3 is a waveform chart illustrating a method of driving the pixel of FIG. 2.

FIG. 3 is a waveform chart illustrating a method of driving the pixel 10 of FIG. 2. The operation of the organic light emitting display according to a driving method of the present invention will be described with reference to FIGS. 2 and 3.

Driving the pixel 10 according to an aspect of the present invention includes of an initializing period T1 for initializing the voltage of the first capacitor C1 of each of the pixels 10, a threshold voltage compensating period T2, in which a threshold voltage Vth is compensated for, a data writing period T3, in which data signals are supplied so that the voltages corresponding to the data signals are charged in the first capacitors C1 of the pixels 10, and an emission period T4, in which the pixels simultaneously emit light with brightness components corresponding to the voltages charged in the first capacitors C1 of the pixels 10.

Initially, when the initializing period T1 that is the first period of one frame period is described, a first scan signal is supplied to the scan line Sn in the initializing period T1 and a second control signal is supplied to the second control line Fn. In addition, the initializing signal V0 is supplied to the data line Dm. The second transistor M2 is turned on by the first scan signal so that the initializing signal V0 supplied from the data line Dm is applied to the gate electrode of the first transistor M1.

In addition, the fourth transistor M4 is turned on by the second on control signal so that the anode electrode voltage of the OLED that is in an off state is applied to the first node N1.

In order to prevent the first power source ELVDD from being applied to the first node N1, the first control signal is not supplied to the third transistor M3 so that the third transistor M3 is turned off in the initializing period T1. Therefore, in the initializing period T1, the voltage corresponding to a difference between the initializing signal V0 and the anode electrode voltage of the OLED is charged in the first capacitor C1.

As noted above, only one pixel 10 was described. However, since the first scan signal and the second control signal are simultaneously supplied to the pixels 10 included in the pixel unit 20 shown in FIG. 1, the first capacitors C1 of the pixels 10 are charged by the voltage corresponding to a difference between the initializing signal V0 and the anode electrode voltage of the OLED in the initializing period T1.

Then, when the threshold voltage compensating period T2 that is the second period in one frame is described, the first scan signal is supplied to the scan line Sn from the initializing period T1 in the threshold voltage compensating period T2 and the first control signal is supplied to the first control line En. At this time, the initializing signal V0 is also continuously supplied to the data line Dm from the initializing period T1 in the threshold voltage compensating period T2.

Since the second transistor M2 is maintained at a turn on state from the initializing period T1 to the threshold voltage compensating period T2 by the first scan signal, the initializing signal supplied from the data line Dm is continuously applied to the gate electrode of the first transistor M1.

In addition, the third transistor M3 is turned on by the first control signal to electrically couple the second electrode of the first transistor M1 to the first node N1. In order to prevent the first node N1 from being coupled to the anode electrode of the OLED, the supply of the second control signal is stopped so that the fourth transistor M4 is turned off. As a result, the first control signal and the second control signal do not overlap (i.e., are not in an on-state) in the initializing period T1 and the threshold voltage compensating period t2. Therefore, the voltage obtained by subtracting the threshold voltage Vth1 of the first transistor M1 from the voltage applied to the gate electrode of the first transistor M1 is applied to the first node N1.

Since the voltage applied to the gate electrode of the first transistor M1 is the initializing signal V0, the voltage of the first node N1 is V0−Vth1. As a result, in the threshold voltage compensating period t2, the voltage of the first node N1 increases from the voltage corresponding to a difference between the initializing signal V0 of the initializing period T1 and the anode electrode voltage of the OLED to V0−Vth1.

Although only one pixel 10 was described above, the first scan signal and the first control signal are simultaneously supplied to the pixels 10 included in the pixel unit 20, and therefore each of the first nodes N1 of the pixels 10 has the voltage of V0−Vth1 in the threshold voltage compensating period T2.

The supply of the first scan signal and the first control signal is stopped so that the period enters into the data writing period T3 that is a third period in one frame period. In the data writing period T3, the second scan signal is supplied to the scan line Sn and the data signal is supplied to the data line Dm to correspond to the supply of the second scan signal. Therefore, the second transistor M2 is turned off as the supply of the first scan signal is stopped and the second transistor M2 is turned on by the second scan signal in order to apply the data signal supplied by the data line Dm to the gate electrode of the first transistor M1.

In order to block the current that flows to the OLED and to smoothly charge the first capacitor C1, the supply of the first control signal and the second control signal is stopped so that the third transistor M3 and the fourth transistor M4 are turned off in the data writing period T3.

The voltage of the first node N1 changes to correspond to the voltage Vdata corresponding to the data signal, which is determined as a ratio of the first capacitor C1 and the second capacitor C2 that are serially coupled to each other.

When the voltage of the first node N1 is referred to as VN1, the voltage VN1 of the first node is represented by the Equation 1.

$$VN1 = \left\{V0 - Vth1 + \frac{C1}{(C1 + C2)}(Vdata - V0)\right\} \quad \text{Equation 1}$$

C1 is the capacitance of the first capacitor C1 and C2 is the capacitance of the second capacitor C2.

Since a data signal is applied to the gate electrode of the first transistor M1 and the above-described VN1 voltage is applied to the first node N1, the voltage corresponding to the data signal, (that is, [Vdata−VN1]) is charged in the first capacitor C1 coupled between the gate electrode of the first transistor M1 and the first node N1.

In the above, only one pixel 10 was described. However, since the second scan signal is sequentially supplied to the scan lines S1 to Sn, the first capacitors C1 of the pixels 10 charge the voltage [Vdata−VN1] corresponding to the corresponding to the data signal.

Then, the first control signal and the second control signal are simultaneously supplied to the pixels 10 through the first control line En and the second control line Fn so that the period enters into the emission period T4 that is a fourth period in one frame period.

At this time, in order to block the data signal supplied to the data line Dm, a scan signal is not supplied to the second transistor M2 so that the second transistor M2 is turned off in the emission period T4.

The third transistor M3 and the fourth transistor M4 are turned on by the first control signal and the second control signal, respectively, so that the second electrode of the first transistor M1 is electrically coupled to the anode electrode of the OLED and the driving current generated by the first transistor M1 may flow to the OLED.

In the first transistor M1, the driving current corresponding to the voltage charged in the first capacitor C1 is generated and the driving current I may be represented as $I=\beta(Vgs-Vth1)^2$ (β is a constant). Since Vgs is a voltage stored in the first capacitor C1, the driving current I may be represented as $I=\beta(Vdata-VN1-Vth1)^2$. When VN1 is replaced by Equation 1, the following Equations 2 and 3 may be obtained.

$$1 = \beta\left(Vdata - V0 + Vth1 - \frac{C1}{C1 + C2}(Vdata - V0) - Vth1\right)^2. \quad \text{Equation 2}$$

$$I = \beta\left(Vdata - V0 - \frac{C1}{(C1 + C2)}(Vdata - V0)\right)^2. \quad \text{Equation 3}$$

As a result, the threshold voltage Vth1 is removed from the driving current I so that the driving current I is not affected by the threshold voltage Vth.

Since the first control signal and the second control signal are simultaneously supplied to the pixels 10 included in the pixel unit 20, the above-described driving current I flows to the OLEDs of the pixels 10 and the OLED generates light corresponding to the driving current I so that the pixels 10 simultaneously emit light.

As illustrated in FIG. 3, the initializing signal V0 may be supplied to the data line Dm in the emission period T4. However, since the second transistor M2 is turned off in the emission period T4, the initializing signal V0 may not be supplied to the pixels 10.

In the emission period T4, as the first scan signal is simultaneously supplied to the pixels 10, the period enters into the initializing period T1. The above-described threshold voltage compensating period T2, data writing period T3, and emission period T4 repeatedly operate.

The first control signal turns on the third transistor M3. When the third transistor M3 is the NMOS transistor as illustrated in FIG. 2, the voltage of the first control signal is in a high level. When the third transistor M3 is the PMOS transistor, the voltage is in a low level.

The second control signal turns on the fourth transistor M4. When the fourth transistor M4 is the NMOS transistor as illustrated in FIG. 2, the voltage of the second control signal is in the high level. When the fourth transistor M4 is in the PMOS transistor, the voltage is in the low level.

In addition, the scan signal turns on the second transistor M2. When the second transistor M2 is the NMOS transistor as illustrated in FIG. 2, the voltage of the scan signal is in the high level. When the second transistor M2 is the PMOS transistor, the voltage is in the low level.

While aspects of the present invention have been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display comprising:

a pixel unit comprising pixels coupled to scan lines, first control lines, second control lines, data lines, and first and second power sources;

a control line driver for providing a first control signal and a second control signal to the pixels through the first control lines and the second control lines;

a scan driver for providing scan signals to the pixels through the scan lines; and a data driver for providing data signals to the pixels through the data lines, wherein the scan driver simultaneously supplies a first scan signal to all of the scan lines of the pixel unit, and wherein each of the pixels comprises:

an organic light emitting diode (OLED) having a cathode electrode coupled to the second power source;

a first transistor having a first electrode coupled to the first power source;

a second transistor having a first electrode coupled to a gate electrode of the first transistor, a second electrode coupled to a data line, and a gate electrode coupled to a scan line;

a third transistor having a first electrode coupled to a second electrode of the first transistor, a second electrode coupled to a first node, and a gate electrode coupled to a first control line;

a fourth transistor having a first electrode coupled to the first node, a second electrode coupled to an anode electrode of the OLED, and a gate electrode coupled to a second control line;

a first capacitor coupled between the gate electrode of the first transistor and the first node; and a second capacitor coupled between the first node and the anode electrode of the OLED.

2. The organic light emitting display as claimed in claim 1, wherein the data driver simultaneously supplies an initializing signal to the pixels through the data lines in a period where the first scan signal is simultaneously supplied to all of the scan lines of the pixel unit.

3. The organic light emitting display as claimed in claim 2, wherein the scan driver sequentially supplies a second scan signal to the scan lines when supply of the first scan signal is completed.

4. The organic light emitting display as claimed in claim 1, wherein each of the first to fourth transistors is a PMOS transistor or an NMOS transistor.

5. A method of driving an organic light emitting display, comprising:

simultaneously supplying a first scan signal and a second control signal to pixels that constitute a pixel unit so that a voltage corresponding to a difference between an initializing signal and an anode electrode voltage of an organic light emitting diode (OLED) is charged in first capacitors of the pixels;

simultaneously supplying the first scan signal and a first control signal to the pixels so that a first node voltage of each of the pixels is increased to a voltage corresponding to a difference between the initializing signal and respective threshold voltages of first transistors of the pixels;

sequentially supplying a second scan signal to the pixels and applying data signals to the pixels to which the second scan signal is supplied so that voltages corresponding to the data signals is charged in the first capacitors of the pixels; and simultaneously supplying the first control signal and the second control signal to the pixels so that the pixels simultaneously emit light with brightness corresponding to the voltages charged in the first capacitors of the pixels.

6. The method as claimed in claim 5, wherein the first control signal and the second control signal do not overlap when simultaneously supplying the first scan signal and the second control signal to the pixels that constitute the pixel unit so that the voltage corresponding to the difference between the initializing signal and the anode electrode voltage of the OLED is charged in the first capacitors of the pixels and when simultaneously supplying the first scan signal and the first control signal to the pixels so that the first node voltage of each of the pixels is increased to the voltage corresponding to the difference between the initializing signal and the respective threshold voltages of the first transistors.

7. The method as claimed in claim 5, wherein the first scan signal is continuously supplied while simultaneously supplying the first scan signal and the second control signal to the pixels that constitute the pixel unit so that the voltage corresponding to the difference between the initializing signal and the anode electrode voltage of the OLED is charged in the first capacitors of the pixels and while simultaneously supplying the first scan signal and the first control signal to the pixels so that the first node voltage of each of the pixels is increased to the voltage corresponding to the difference between the initializing signal and the respective threshold voltages of the first transistors.

8. The method as claimed in claim 5, wherein the initializing signal is continuously supplied while simultaneously supplying the first scan signal and the second control signal to the pixels that constitute the pixel unit so that the voltage corresponding to the difference between the initializing signal and the anode electrode voltage of the OLED is charged in the first capacitor and while simultaneously supplying the first scan signal and the first control signal to the pixels so that the first node voltage of each of the pixels is increased to the voltage corresponding to the difference between the initializing signal and the respective threshold voltages of the first transistors.

* * * * *

UNITED STATES PATENT AND TRADEMARK OFFICE

CERTIFICATE OF CORRECTION

PATENT NO. : 8,570,250 B2
APPLICATION NO. : 12/975843
DATED : October 29, 2013
INVENTOR(S) : Chul-Kyu Kang et al.

It is certified that error appears in the above-identified patent and that said Letters Patent is hereby corrected as shown below:

In the Claims

Column 10, Claim 5, line 7 Delete "is"

Insert -- are --

Signed and Sealed this
Ninth Day of June, 2015

Michelle K. Lee

Michelle K. Lee
*Director of the United States Patent and Trademark Office*